United States Patent [19]

Lange

[11] Patent Number: 4,903,384

[45] Date of Patent: Feb. 27, 1990

[54] APPARATUS FOR THE MANUFACTURE OF A ROLL OF COILED, CLAMPED BARBED WIRE

[75] Inventor: Gerhard Lange, Reutlingen, Fed. Rep. of Germany

[73] Assignee: Wafios Maschinenfabrik GmbH & Co. Kommanditgeseilschaft, Fed. Rep. of Germany

[21] Appl. No.: 213,763

[22] Filed: Jun. 30, 1988

[30] Foreign Application Priority Data

Jun. 30, 1987 [DE] Fed. Rep. of Germany ..... 3721466

[51] Int. Cl.[4] ..... B21F 25/00

[52] U.S. Cl. ..... 29/7.1; 29/7.2; 29/7.3; 140/58

[58] Field of Search ..... 29/7.1, 7.2, 7.3; 140/58

[56] References Cited

U.S. PATENT DOCUMENTS

| | | | |
|---|---|---|---|
| Re. 30,814 | 12/1981 | Mainiero | 29/7.2 X |
| 241,256 | 5/1881 | Watkins | 29/7.1 |
| 390,975 | 10/1888 | Jordan et al. | 29/7.1 |
| 3,916,958 | 11/1975 | Uhl | 140/58 X |

FOREIGN PATENT DOCUMENTS 1451018 8/1974 United Kingdom .

*Primary Examiner*—Timothy V. Eley
*Assistant Examiner*—Frances Chin
*Attorney, Agent, or Firm*—Wigman & Cohen

[57] ABSTRACT

A method and apparatus for providing barbed strap coils without a core by means of a ring coiling device (50) that has no winder provides a single clamping device (96), whereby the coiling is interrupted for the placement of a clamp. A guide device (11B) is arranged in front of the clamping device (6) by means of which two strap sections separated by the one loop can be pushed toward the clamping device (96) by means of a strap feeding device (38). The two coils are guided outside the interruption in the coiling synchronously and in like phase through the location where the clamps are applied, by a synchronization device (60) in the clamping device (96) which engages slip-free in the two strap sections by means of a member (62). A counter (80) that counts the member movements between two successive clamping steps is coupled with member (162).

15 Claims, 8 Drawing Sheets

Fig. 10
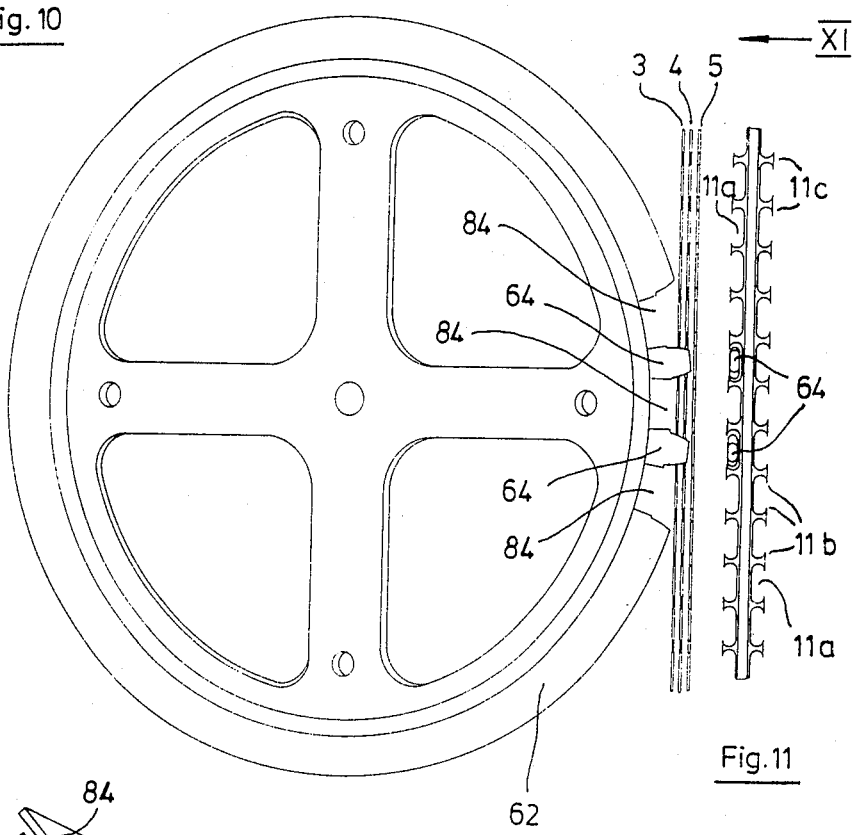
Fig. 11
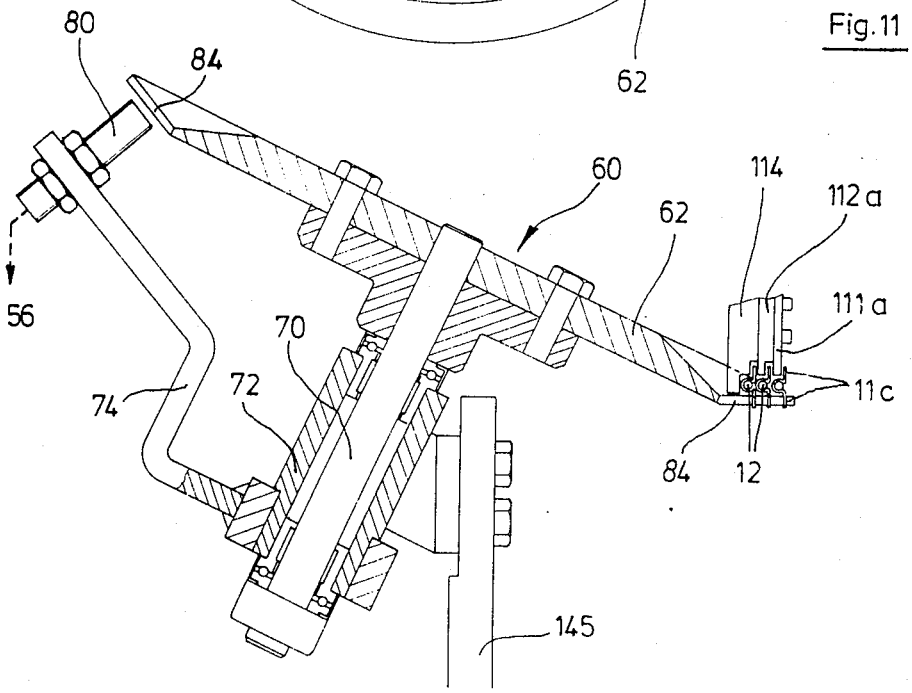
Fig. 12

APPARATUS FOR THE MANUFACTURE OF A ROLL OF COILED, CLAMPED BARBED WIRE

BACKGROUND OF THE INVENTION

The present invention relates to a method and apparatus for the manufacture of a roll of coiled barbed strap, and more particularly to such a coiled barbed strap the loops of which, in pairs, are provided with an odd number of clamps of at least three per loop and are axially separable from each other within each roll, such that each strap loop passes around one screw line.

A prior art method of producing coiled barbed strap is illustrated in FIGS. 1 through 4 of German Pat. No. 23 48 714. According to the thus known method, the barbed strap is coiled, the clamps corresponding to the number of clamps per coil are placed on two adjacent loops and the barbed strap is cut after the last clamp is placed. To this end the barbed strap loops are produced with the aid of a cylindrical winder in the core through continuous coiling of the barbed strap, which is under tension, whereby the winder is continuously displaced in the direction of its longitudinal and rotational axis in accordance with the inclination of the strap loops, so that the winder performs a screw-type movement. Prior to the beginning of this screw-type movement, the beginning end of the tangentially supplied barbed strap is detachably connected to one end of the winder. A rotary table is arranged coaxially to the winder, which table revolves synchronously with the winder but remains still axially. This rotary table supports a plurality of clamping devices, namely five, for example, which corresponds with the number (five) of clamps for every two loops of the barbed strap, so that during the uninterrupted rotation of the winder, each clamping device is activated one for every two rotations, thereby connecting two adjacent loops of the barbed strap by a clamp.

It is disadvantageous in the known method that the lengths of the strap loops produced by winding the barbed strap onto radial ribs of the winder can vary as a result of failures during production (stamping and edging process) of the barbed strap and/or as a result of nonuniform welding of the cross bars of the winder an that, in some cases, the strap sections, which are crimped to assist in the crease closure of the crimped barbed strap around a support wire, do not rest with sufficient phase-equal precision beneath the clamping devices to allow the clamping to be performed without difficulty.

SUMMARY AND OBJECTS OF THE INVENTION

An object of the invention, therefore, is to provide a method of the type described above which avoids this disadvantage, in that its performance does not suffer difficulty in clamping adjacent wire coils, or even fail completely thereby, and also requires a smaller machinery expense.

This object is achieved according to the invention in that the barbed strap coils are produced without a core, in that the coiling of the barbed strap according to the number of clamps per coil is frequently interrupted at predetermined intervals so that a clamp is placed while stationary, and in that the two coils of the barbed strap to be clamped, outside of the interruption intervals, are guided synchronously and in like phase through the location of clamp placement.

Aside from the fact that only a single clamping device is necessary to perform the method according to the invention, and that a winder having cross ribs is no longer necessary at all, this method has the decisive advantage that the clamps can always be placed correctly, even if the barbed strap to be coiled and provided with clamps exhibits manufacturing defects, as long as they do not exceed certain common tolerances. In addition, this method makes it possible without difficulty to apply clamps on as many strap locations as desired.

In a preferred manner of performing the method according to the invention, a bit more than one coil is formed with no clamps from the barbed strap after placement of the last clamp, and then the first clamp of the next roll is placed, whereby simultaneously the barbed strap is cut between these first and last clamps. In this manner the first coils of the next roll are produced automatically, so that it is not necessary as with the first roll to coil the beginning of the barbed wire manually until the first clamp is placed. Advantageously, the interruption in the coiling of the barbed strap and the placement of a clamp, as well, perhaps, as the cutting of the barbed strap are program-controlled, whereby the length of the drawn-in barbed strap is used as a measurement value. In this case, the method according to the invention, from its beginning, can be performed by means of a completely automatic apparatus.

The invention also relates to an apparatus for performing the method according to the invention, because the apparatus known from the German Pat. No. 23 48 714 having a strap draw-in device, coiling device, at least one clamping device and a cutting device, requires not only a plurality of clamping devices, but also has the disadvantage that rolls of coiled, clamped barbed strap can only be manufactured in a diameter corresponding to the diameter of the winder which is enlarged by the cross ribs, and with a clamp distribution that is dependent on the given number of clamping devices. To manufacture a roll with a different diameter and/or a different clamping distribution, a major conversion of the known apparatus is necessary, and in fact, an entirely separate similar apparatus may need to be set up.

The invention also has as an object, therefore, an apparatus that avoids this disadvantage and has the necessary devices for drawing in the strap, forming the coil, and performing the clamping and cutting, which can be converted or adjusted at relatively little cost in such a manner that it can be used to manufacture rolls of coiled barbed strap of varying diameter and different clamp distribution.

This object is achieved according to the invention in that a winderless coiling device and a single clamping device are provided as the coil forming device, in that a guide device is arranged, as viewed in the direction of movement of the barbed strap, in front of the clamping device, by means of which two sections of said barbed strap that are to be clamped together and are separated by one coil of the barbed strap can be pushed toward the clamping device with the desired permanent curvature by means of the strap draw-in device, and in that a synchronization device is located with the clamping device, which, by means of the same movable member engages slip-free in the two strap sections to be clamped, and has a counter coupled with this member that counts the member movements between two successive clamp positions.

In this manner it is advantageously achieved that for a change in the roll diameter, there need only be made corresponding changes in the coiling device and the guide device, as well as perhaps the synchronization, clamping and cutting device, and that a new arrangement of the clamping distribution is possible without any apparatus conversion simply through a corresponding control of the clamping device.

A preferred embodiment of the apparatus according to the invention for automatically performing the method according to the invention is distinguished by an electronic program control device, which is electrically connected on one side with the counter, which is formed as an electrical impulse indicator, and on the other side with the drive of the strap draw-in device, so that rolls of equal diameter but having different clamp distribution can be produced in succession from endless barbed strap, even with variable speed.

The coiling device of the preferred embodiment includes: a drivable guide drum at the exit of the strap draw-in device and beneath two parallel guide rollers of small diameter, which can be moved relative to the machine frame, as well as three movable strap bending rollers arranged in succession at the height of and behind the strap draw-in device, and perhaps guide rollers along the path of the barbed strap between the strap draw-in device and the guide device. In this manner the coiling device can be adapted with relative simplicity to different roll diameters.

In the preferred embodiment the guide device has exchangeable elements with internal shapes that are adapted to the cross-sectional shape and perhaps also to the bending radius of the barbed strap, so that different curvatures of the barbed strap can be accommodated with no difficulty for different roll diameters and, less often, a change in the shape.

In the preferred embodiment the synchronization device has, as the movable member, a free-running gear with teeth whose relative spacing around the periphery of the gear corresponds to the distance of an oval opening in the barbed strap from the second next such opening, whereby a hole is formed between two successive teeth, the length and height of which makes it possible for one pincer leg of a clamp pincer of the clamping device to pass therethrough. This embodiment of the synchronization device is especially effective and also simple, particularly since according to the preferred embodiment a switch that has no contact but cooperates with the gear can be provided as the electrical impulse indicator.

In the preferred embodiment it is provided that the guide drum is mounted in a stationary manner, and that the guide device, the synchronization device, the clamping device and the cutting device are arranged in common on a movable apparatus element, which can be moved along a 45 degree inclined line in a vertical plane to adjust these devices to a different roll diameter, perhaps by means of a spindle, whereby the effective point of the clamping device on the path of the barbed strap and its point of contact on the crown of the guide drum are always removed from each other by a quarter circle of this path. In this manner a conversion of the apparatus is unnecessary for changing the roll diameter. A new setting of the preferably plate-like movable apparatus element supporting the known devices, and the coiling device, excluding the guide drum thereof, are sufficient for such a change. Thereby it is especially provided that of the strap bending rollers arranged in the vicinity of the guide drum, one stationary roller is positioned on the crown of the horizontal drum and the two other rollers are arranged on different sides of the path of the barbed strap between the drum and the stationary roller on one side and the guide device on the other side so as to be positioned by means of respective adjusting device, and that the guide rollers of the coiling device are individually movable about horizontal pivot axes, and can slide along a line running parallel to the sliding line.

Advantageously, the coiling device is provided with an ejection device for removing the finished rolls that have been cut from the following barbed strap, and this ejection device has a push plate that acts on the end of the roll facing the apparatus and is activated by a cylinder.

Finally, in the preferred embodiment it is also provided that the synchronization device has a movable member, a free-running gear with teeth whose spacing measured along the periphery of the gear corresponds to two adjacent pairs of wings of the barbed strap, whereby at least one tooth has a recess, the length and height of which makes it possible for a pincer leg of a clamp pincer of the clamping device to pass therethrough. This allows the smooth clamping of the coils of a strap with a relatively large spacing of the barbs from each other as measured along the path of the strap.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 10 is an enlarged second section from FIG. 4 with a synchronization device of the embodiment in the opposite side view (FIG. 4, from the left), FIG. 11 is a partially illustrated frontal view of FIG. 10 as viewed in the direction of the arrow XI in FIG. 10, FIG. 12 is an enlarged first portion of the apparatus of FIG. 7 with the synchronization device illustrated partially in section.

DETAILED DESCRIPTION OF THE PREFERRED EMBODIMENTS

Figure 1:
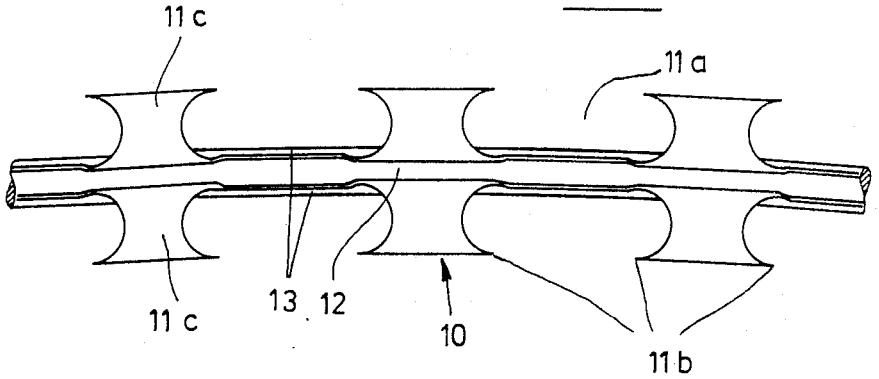
FIG. 1 is a curved barbed strap section in top view.
Figure 8:
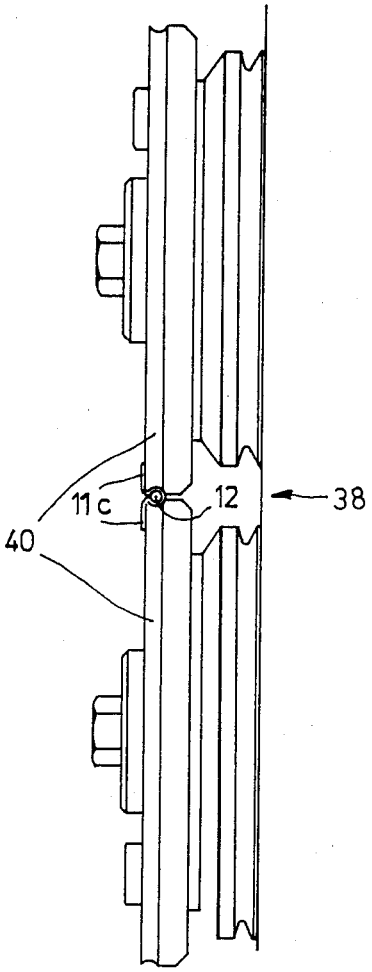
FIG. 8 is an enlarged section of a draw-in device of the embodiment in side view.
Figure 2:
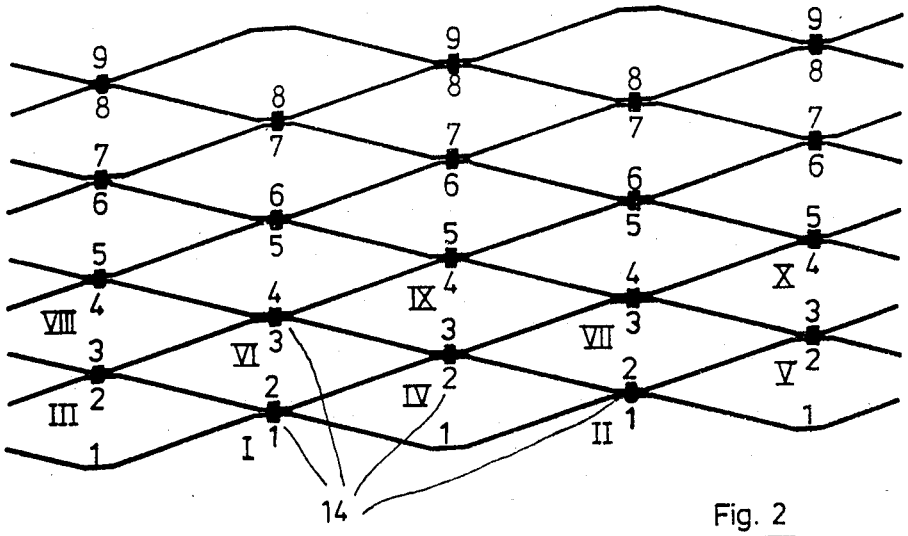
FIG. 2 is a schematic illustration of an axially spread apart coil with clamps in a plane.

Referring now in detail to the drawings wherein like parts are designated by like reference numerals throughout, there is illustrated in FIG. 1, an originally flat barbed strap 10 provided on its two edges with oval cutouts 11*a* that leave pointed barbs 11*b* on coplanar wings 11*c*. Between the rows of cutouts 11*a* that oppose each other perpendicularly to the longitudinal direction of the strap, there remains a narrow strap web 13. This strap 10 is creased on one side in the center over its entire length, including in its wing sections, so that a support wire 12 of spring steel can be embedded therein. After the embedding there takes place a crimping of the strap web 13 between two successive wing pairs, so that the support wire 12 is securely surrounded. The thus-formed barbed strap is then formed into a coil by winding, the layout of which is shown in FIG. 2, which shows that a clamping of adjacent winding coils 1 through 9 is provided by means of clamps 14 distributed in equal fifths relative to the periphery of two windings. Any uneven number of divisions is possible.

Figure 4:
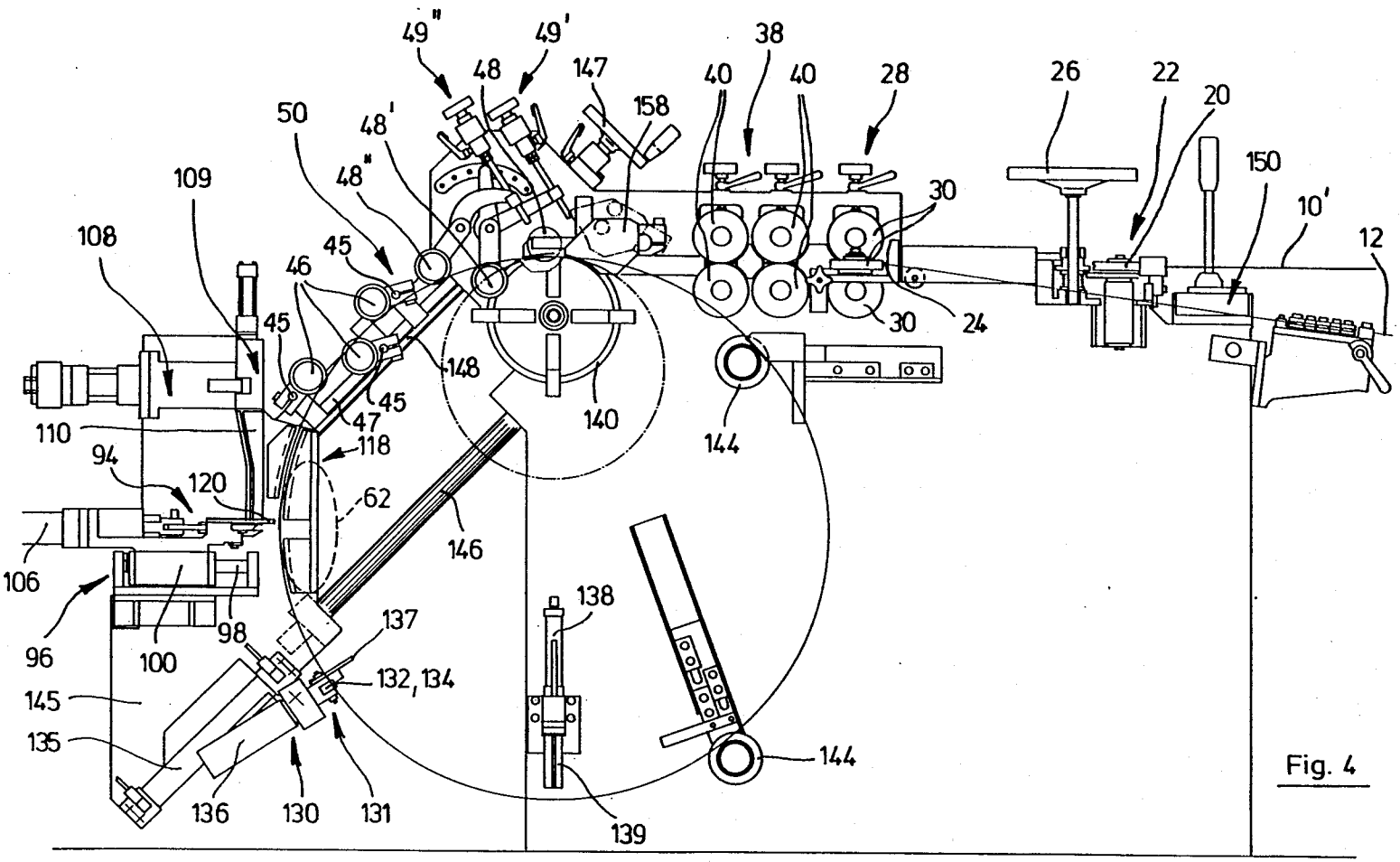
FIG. 4 is a front view of an embodiment of the apparatus in accordance with the invention.
Figure 7:
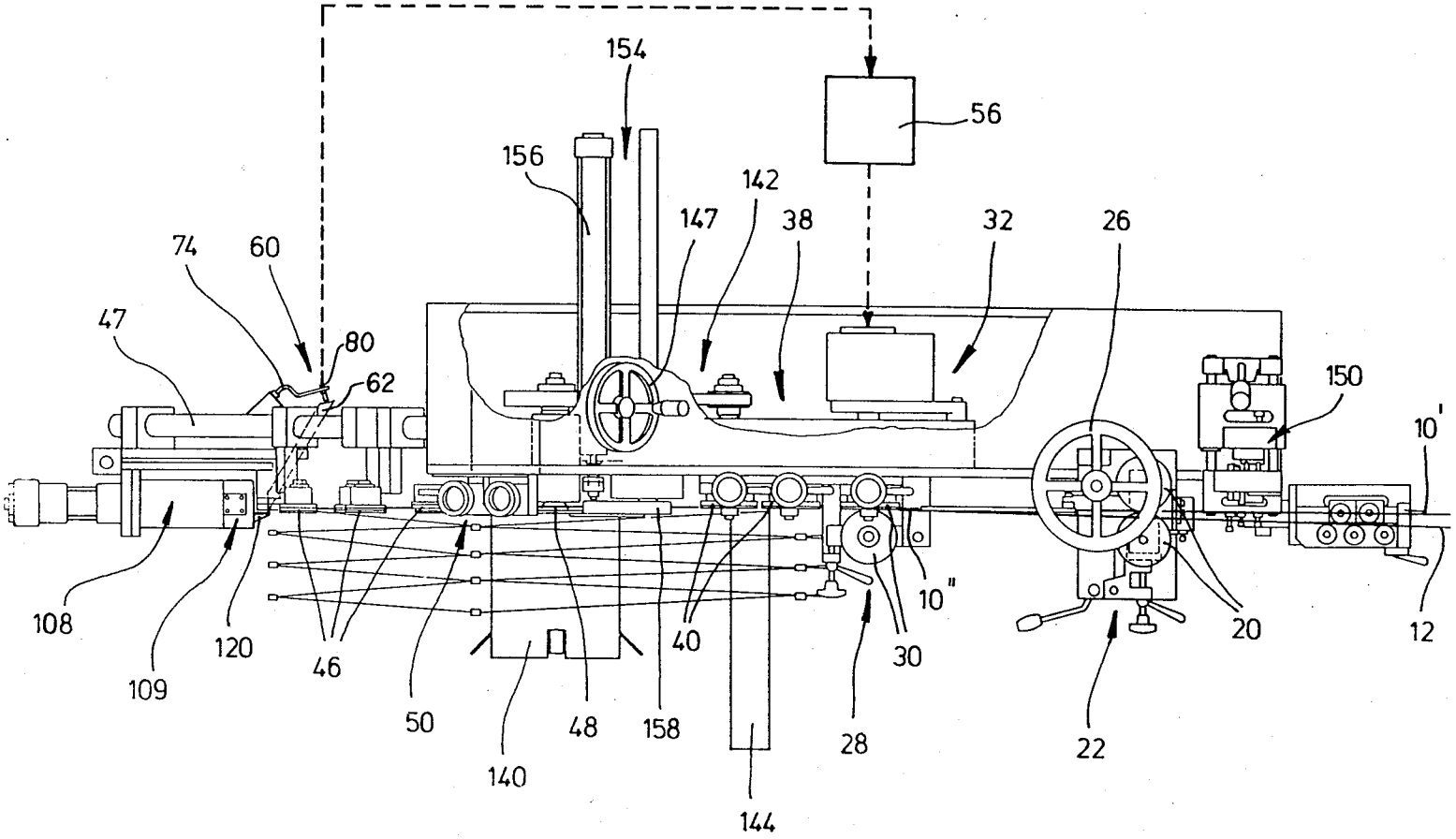
FIG. 7 is a top view of the embodiment.

As shown in FIGS. 4 and 7, the wire-free, completely flat barbed strap 10′ coming from a supply roll (not shown) is guided into a creasing device 22 by a pair of rollers (20) to crease the flat barbed strap 10′ so that it can receive the support wire 12 in the crease. The support wire 12 coming from a supply roll (not shown) is introduced at the point 24 from the side and below into the open crease in the barbed strap 10″. Rollers 30 of a crimping device 28 effect the crimping of the strap web 13, so that the support wire 12 is securely surrounded. The crimping rollers 30 are driven by means of a regulated direct current drive 32. Two draw-in roller pairs 40 of a draw-in device 38 are driven by intermediate gears by this single drive 32 of the apparatus. The roller pair 20 of the creasing device 22 is not driven; the barbed strap 10′ is pulled through the rollers 20 by the draw-in roller pairs 40.

Figure 9:
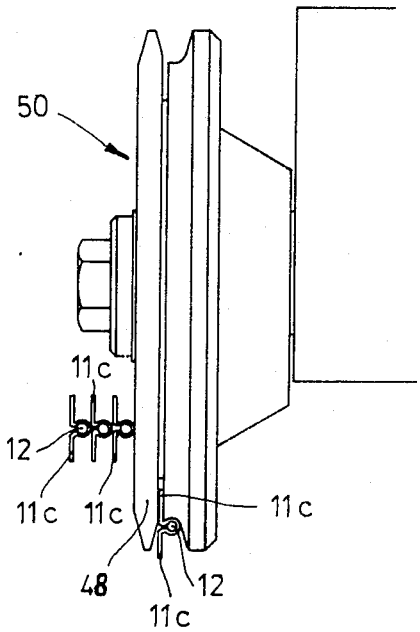
FIG. 9 is an enlarged section of a guide roller of a coiling device of the embodiment in the same side view (FIG. 4, from the right)
Figure 6:
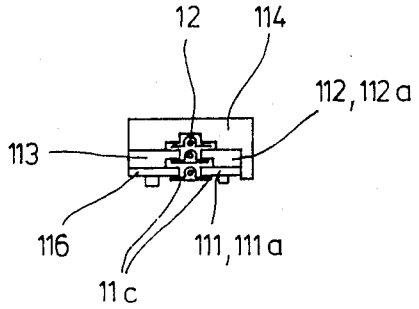
FIG. 6 is a portion of the illustration from FIG. 5 in top view in the direction of arrow VI in FIG. 5.

The finished barbed strap 10 is fed by the draw-in roller pairs 40 to three bending rollers 48, 48′, 48″ and three following guide rollers 46 of a stationary coiling device 50 and is formed into a coil by these rollers 46 and 48. The rollers 46 and 48 are formed in such a manner that the barbs 11*b* of the barbed strap 10 pass unhindered through these rollers and the barbed strap 10 with the inserted support wire 12 is rounded in the plane of its wings 11*c* without deforming them; see FIG. 9. A guide device 118 attached to a plate 145 is provided to guide the wings 11*c* of the two coils of the barbed strap 10 to be clamped, which guide device 118, according to FIG. 6, includes as exchangeable elements three covers 111, 111*a* and 116 that guide a front coil of the barbed strap 10 on its wings 11*c*, three guide elements 112, 112*a* and 113 that guide a center coil and a guide support 114 that guides a rear coil, which together guarantee a certain curvature of the strap.

The barbed strap 10 is moved over the guide rollers 46 of the coiling device 50 and the guide device 118 to a synchronization device 60 attached to the plate 145, in which device 60 two adjacent, successive coils are guided in such a manner by an inclined gear 62 whose teeth 64 engage in the cutouts 11*a* of the barbed strap 10 that the wing pairs 11*c* of the rounded barbed strap 10 align to cover each other and these two coils can be clamped at the point where the two strap webs 13 lie opposite one another, in predetermined distances according to the coil division chosen.

The gear 62 is formed in such a manner that its teeth 64 engage in every other cutout 11*a* of the barbed strap 10. The gear 62 is connected with one end of a shaft 70 mounted in a bearing block 72 so as to freely rotate therewith, so that the gear 62 rotates with said shaft 70 and so that the gear 62 can be rotated by the forward movement of the barbed strap 10. A holder 74 is attached to the bearing block 72 and a contact-free switch 80 is arranged on the free end of this holder 74 as an electrical impulse indicator that inductively reacts to the teeth 64 of the gear 62 and thereby generates electrical control impulses with a frequency proportional to the speed of the strap.

Between every two teeth 64 of the gear 62 recesses 84 are provided which are formed as tooth gaps so that pincer legs 90 and 92 of a clamping pincer 94 can dip into these recesses 84, which would also be possible if, with long teeth for a greater spacing between adjacent pairs of wings 11*c*, a recess were provided in at least one of these teeth instead of a hole between two adjacent teeth.

Figure 13:
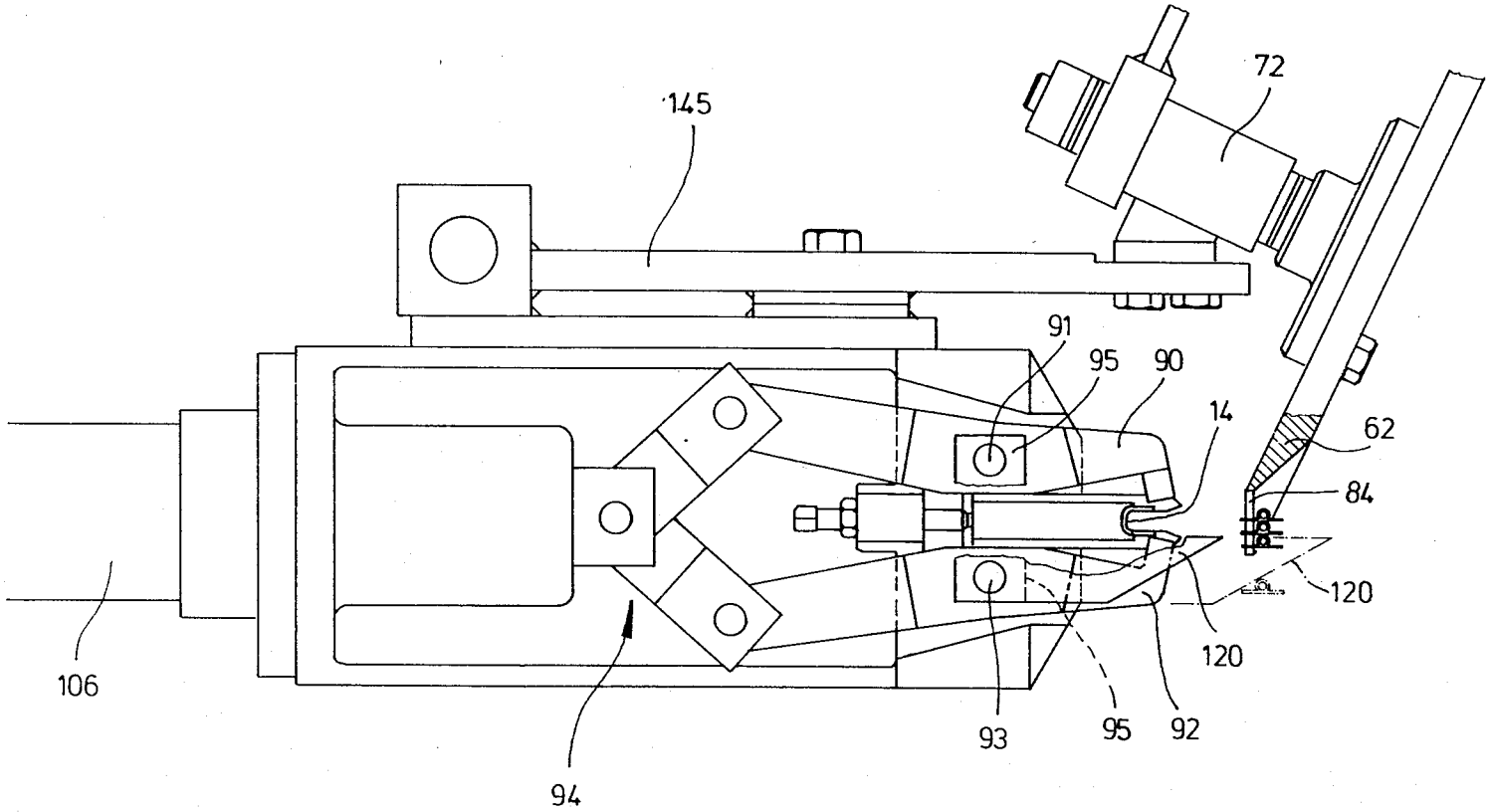
FIG. 13 is an enlarged second portion of the apparatus of FIG. 7 illustrating a clamping device of the embodiment.

A clamping device 96 is attached to the plate 145 to the left of the gear 62, as shown in FIG. 4. This device 96 possesses a double-acting pneumatic linear drive with a stationary piston rod 98 and a movable outer runner 100. This outer runner 100 can be moved into a forward and a rear position relative to the synchronization device 60. A clamping pincer 94 is arranged on the outer runner 100, the legs 90 and 92 of which, as shown in FIG. 13, can be closed and reopened by means of a cylinder 106, after the outer runner 100 of the linear drive has traveled with the clamping pincer 94 into its forward position. The clamps 14 necessary for the clamping process are stamped from strap material in a stamping device 108, bent into s U-shape in a bending device 109 and, lined up in the magazine 110 they are supplied to the clamping device 96 and passed individually to the clamping location between the pincer legs 90 and 92, so that the closing of the pincer legs 90 and 92 accomplishes the clamping of two adjacent coils of the barbed strap 10.

The number of clamps 14 to be applied to the barbed strap 10 coil must be a whole number portion of the number of cutouts 11*a* in the strap.

According to FIG. 13, the non-rotating pivot axes 91 and 93 of the pincer legs 90 and 92 are connected by means of a clip 95 to which a coil guard 120 is attached adjacent to the pincer leg 92, which coil guard 120, as the clamping pincer 94 moves forward for the purpose of clamping, in one of the recesses 84 of the gear 62 separates the last clamped coil of the barbed strap 10 from the two coils to be clamped thereafter and thus keeps open the operating area of the clamping pincer 94.

Figure 5:
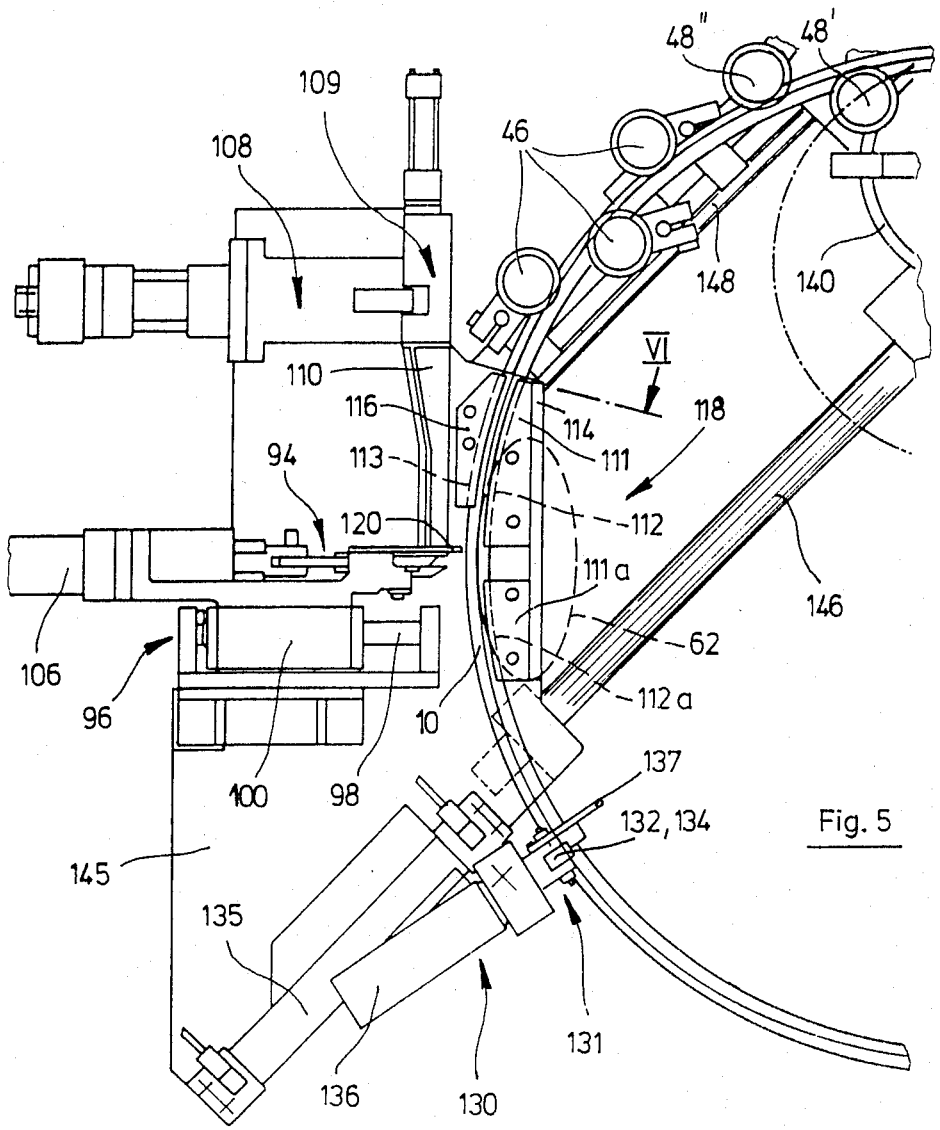
FIG. 5 is an enlarged view of a portion of the apparatus illustrated in FIG. 4.

At a point approximately equal to half the clamping spacing distance away from the clamping point and beneath the clamping device 96, there is arranged on the plate 145 a cutting device 130 for cutting the barbed strap 10 as soon as the predetermined number of coils has been produced. The active portion of this cutting device 130, namely a cutting pincer 131 with cutting jaws 132 and 134, is pivotably arranged, as shown in FIG. 5, on a cylinder 135 with no piston rod having an integrated guide and force transfer system, so that the cutting jaws 132 and 134 of the pincer 131 can always be directed toward the center of the coil. The pincer 131 is moved into the cutting position by means of the cylinder 135 and the cutting jaws 132 and 134 are activated by means of a cylinder 136, like the pincer 94 of the clamping device 96.

Because the clamping of two coils of the barbed strap 10 in the clamping device 96 and the cutting of the barbed strap in the cutting device 130 take place at the same time when the predetermined number of loops in the coil has been reached, the clearing of the operating area of the clamping and cutting devices 96 and 130, respectively of finished loops of the coiled barbed strap 10 can be accomplished by one and the same loop guard, namely the guard 120 on the clamping pincer 94, whereby, in accordance with FIG. 4, a loop guard 137 on the cutting pincer 131, as it travels forward, and a wedge-shaped loop guard 139 that is moved by means of a cylinder 138, cooperate.

Figure 3:
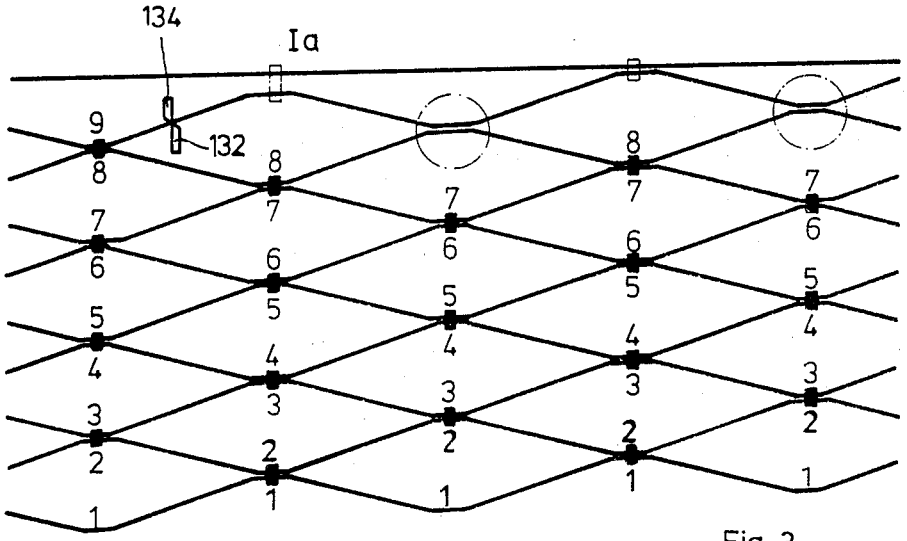
FIG. 3 is a similar schematic illustration to illustrate the strap cutting process.

In order that a single cut instead of three is sufficient to cut the barbed strap 10, it is necessary that the clamping is performed twice before the cut command is given, as indicated in FIG. 3 by the broken lines. This is accomplished simply by means of the fact that the outer runner 100 and the cylinder 106 of the clamping device 96 are twice not acted upon by the pressure medium.

The forming loops of the coiled barbed strap 10 collect in the coiling device 50, hanging on a stationary upper horizontal surface of a guide drum 140 which is driven by a belt drive 142 by the extended shaft of the draw-in rollers 40. The freely forming coil is also formed by two adjustable, horizontal, freely rotating guide rollers 144 beneath the drum, which cooperate with the parallel guide drum 140 and the guide device 118.

The synchronization device 60, the guide device 118, the clamping device 96 and the cutting device 130 are attached in common to the vertical plate 145, which can be moved along a round guide rod 146 arranged in a vertical plane and inclined 45 degrees from the horizontal by means of a hand wheel 147 and spindle 148 with all of the devices located thereon 60, 118, 96 and 130, in order to adapt to a different coil diameter. The bending rollers 48' and 48'' are moved for this purpose by means of adjusting devices 49' and 49'' into the adapted position, while the bending roller 48, positioned earlier, remains in place for all coil diameters. The guide rollers 46, according to FIG. 7 (left), are movably and pivotably arranged on a guide rod 47 corresponding to the guide rod 146 for the plate 145, and thus can be adapted to the chosen coil diameter, whereby, however, one, two or all three of the guide rollers 46 might not be necessary. The horizontal pivot axes 45 for pivoting the whole guide rollers around said axes 45 are arranged on guide rod 47 as shown in FIG. 4 (lrft-hand side).

An ejection device 154 is provided to remove the separated roll, which device has a push plate 158 that is activated by a cylinder 156 and slides the roll away from the guide drum 140 and the guide rollers 144.

The method of operation of the described apparatus is, to the extent it is not apparent, as follow:

For an initial manual introduction of the still flat, wire-free barbed strap 10' at the beginning of the coiling into the non-driven roller pair 20 of the creasing device 22, the barbed strap 10' is creased by means of a manually activated creasing device 150 until it can be manually pushed between the creasing roller pair 20. With the aid of an engageable hand wheel 26 the creased strap 10'' is pushed forward until it extends under the driven draw-in roller pair 40, which then take over the further pulling through the creasing device 22. After the support wire 12 has been introduced into the crease in the strap 10'' and surrounded by means of the crimping rollers 30, the draw-in rollers 40 push the finished barbed strap 10 past the guide drum 140 and between the bending rollers 48, 48' and 48'', which are set such that a barbed strap coil with a predetermined diameter is wound.

The curved barbed strap 10 is manually guided over the guide rollers 46 so that one row of its cutouts **11*a* are fed into the teeth 64 of the gear 62 (FIGS. 10 and 11). The barbed strap 10 is continuously wound and thereby manually guided around the guide drum 140 and the two guide rollers 144 until the cutouts 11*a* of the second loop of the barbed strap are also introduced into the teeth 64 of the gear 62 of the synchronization device 60**.

After one cutout 84 of the gear 62 with these two loops is centered for the first time in front of the clamping pincer 94, the coiling process is interrupted by a brief interruption in the drive 32 of the draw-in rollers 40. Then, in succession, the outer runner 100 of the linear drive and the cylinder 106 of the pincer legs 90 and 92 of the clamping device 96 are manually activated once and acted upon by the pressure medium, thereby producing the first clamp. After the outer runner 100 and the cylinder 106 have returned to their original condition, the noncontact switch 80 of the synchronization device 60 is activated.

From this point on, the coiling and clamping of the loops of the barbed strap 10 take place fully automatically by means of an electrical program control device 56. In addition, after the renewed starting of the draw-in roller drive 32, between which rollers this device 56 is connected, the noncontact switch 80 begins measuring the completed peripheral distance traveled by the gear 62 that is forced into rotation by the barbed strap 10 by adding the individual impulses. Thereby, each impulse best corresponds to one recess 84 of the gear. If the gear 62 has completed the distance from clamp I to clamp II (FIG. 2), where the Roman numerals indicate the order of placement of the clamps 14, the drive 32 of the draw-in rollers 40 is interrupted by the program control for a renewed clamping step. After a certain number of clamping steps have been performed, which corresponds to a certain number of loops of the barbed strap 10, as stated earlier, two clamps are placed and simultaneously with the first clamping of the first loop of the next coil the barbed strap 10 is cut by the cutting device 130 (FIG. 3), so that the hand guiding of the first loop of the first coil is unnecessary for the following coils, as long as the strap supply lasts. Subsequently, the formed roll is pushed away by the ejection device 154.

Advantageously, at the point in time in which a recess 84 of the gear 62 provided for the clamping, is, for example, two or more teeth away from their exact position on the clamping device 96, the drive 32 of the draw-in rollers 40 is switched by a so-called (functional) ramp to slow speed, so that this recess reaches the clamping device in the correct position.

Figures 14, 15:
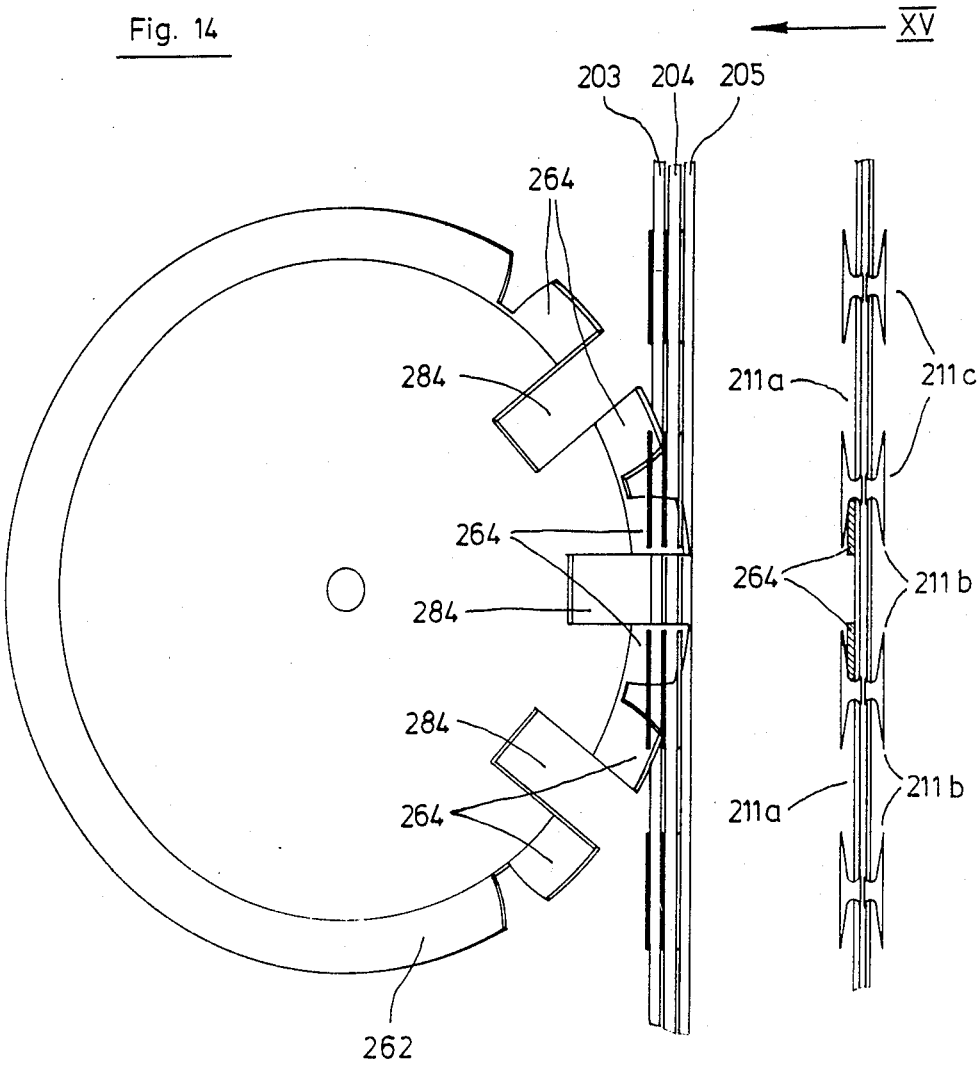
FIG. 14 is an illustration corresponding to FIG. 10 of a variation of the synchronization device with a gear that has longer teeth and shorter tooth holes.
FIG. 15 is an illustration corresponding to FIG. 11 as viewed in the direction of the arrow XV in FIG. 14.

In one variation of the synchronization device 60, the gear 262 for a barbed strap illustrated in FIG. 15, having a greater spacing distance between two adjacent pairs of wings **211*c* with barbs 211*b*, i.e., having longer recesses 211*a* in the barbed strap, according to FIG. 14, has correspondingly long teeth 264 and relatively short tooth gaps. Each of these relatively long teeth 264 has in the center a rectangular recess 284 for the engagement of the tooth leg 90 of the clamping pincer 94 of the clamping device 96**.

As shown in FIG. 14 when compared with FIG. 10, numerals for like or corresponding parts are increased by 200.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. Apparatus for the manufacture of a circular roll of coiled barbed strap which is formed into loops, the loops of which are provided in pairs with clamps in an uneven number of at least three per loop and can be separated from each other in the axial direction of the roll in such a manner that each strap loop pivots about a screw-type line, in which the barbed strap is coiled, in which clamps are placed on every two adjacent loops according to the number of clamps per loop, and after the last clamp is placed, the barbed strap is cut, comprising:

a strap draw-in device, a coiling device, a clamping device and a cutting device;

wherein said coiling device and said clamping device are provided as a winderless coiling device and a single clamping device, respectively;

wherein as viewed in the direction of movement of and along the barbed strap a guide device is arranged in front of said single clamping device by means of which two separate sections of the barbed strap to be clamped are separated from each other by one loop, and are supplied with a desired permanent curve to said single clamping device via the strap draw-in device; and wherein a synchronization device is located near said single clamping device, which synchronization device engages positively, by means of movable members, without slip in two strap sections connectable by clamps, and has a counter coupled with said movable member that counts the movable member movements between two successive clamping steps.

2. Apparatus according to claim 1, wherein said strap draw-in device is provided with a drive, further comprising an electronic program control device which is electrically connected on one side with the counter, said counter being formed as an electrical impulse indicator, and on the other side with the drive of the strap draw-in device.

3. Apparatus according to claim 2, wherein a noncontact switch that cooperates with the gear is provided as the electrical impulse indicator.

4. Apparatus according to claim 1 further including a machine frame, wherein the coiling device includes a drivable horizontal guide drum at the outlet arranged behind the strap draw-in device in the direction of movement of the barbed strap, two parallel guide rollers of smaller diameter that are located beneath the drum and can be moved on the machine frame, and three strap bending rollers that are arranged successively and each displaceably, approximately at the level of the strap draw-in device behind said device when viewed in the direction of movement of and along the barbed strap.

5. Apparatus according to claim 4, wherein the guide drum is mounted in a stationary manner and the guide device, the synchronization device, the clamping device and the cutting device are mounted in common on a movable apparatus element which can slide along a slide line that is inclined at 45 degrees in a vertical plane to adjust said guide device, synchronization device, clamping device and cutting device to a different roll diameter, whereby an operating station of the clamping device on the path of the barbed strap and its point of contact on the guide drum are always removed from each other by a quarter circle of this path.

6. Apparatus according to claim 5, further including strap guiding rollers located along the path of the barbed strap between the strap draw-in device and the guide device, each of said strap guiding rollers being mounted on a horizontally disposed pivot axis, wherein the guide rollers of said winderless coiling device can be moved individually about said horizontally disposed pivot axes and can be pushed along a second line running parallel to said slide line.

7. Apparatus according to claim 5, wherein said movable apparatus element is slidable by means of a spindle.

8. Apparatus according to claim 4, wherein the strap bending rollers are arranged in the vicinity of the guide drum, one stationary roller being positioned on the horizontal drum and the two other rollers being arranged on different sides of the path of the barbed strap between the drum and stationary roller on one side and between the drum and the guide device on the other side and can be positioned by means of respective adjusting devices.

9. Apparatus according to claim 4, wherein the coiling device is provided with an ejection device to remove a finished roll that has been cut from the barbed strap which has been coiled by said coling device, and this ejection device has a slide plate that is activated by a cylinder, which slide plate acts on the end of the roll facing the apparatus.

10. Apparatus according to claim 4, further including strap guiding rollers located along the path of the barbed strap between the strap draw-in device and the guide device.

11. Apparatus according to claim 1, wherein the guide device includes exchangeable elements with inner forms adapted to the cross-sectional shape of the barbed strap, said cross-sectional shape of the barbed strap being the shape of said strap as viewed in a plane which is normal to the longitudinal axis of said strap.

12. Apparatus according to claim 11, wherein the inner forms of the exchangeable elements are further adapted to the bending radius of the barbed strap to be formed at said guide device.

13. Apparatus according to claim 1, in which said strap is formed with alternating cutouts and wings, wherein the movable member of the synchronization device comprises a free-running gear with teeth, the spacing of which teeth measured on the periphery of the gear corresponds to the spacing of a first cutout in the barbed strap from the second next such cutout, whereby a hole is formed between any two successive teeth, the length and height of which hole makes it possible for a pincer leg of a clamping pincher of the clamping device to pass therethrough.

14. Apparatus according to claim 13, wherein said strap draw-in device is provided with a drive, further comprising an electronic program control device which is electrically connected on one side with the counter, said counter being formed as an electrical impulse indicator, and further wherein a noncontact switch that cooperates with the gear is provided as the electrical impulse indicator.

15. Apparatus according to claim 1, in which said strap is formed with alternating cutouts and wings wherein the synchronization device has, as the movable member, a free-running gear with teeth, the length of said teeth measured on the periphery of the gear corresponding to the cutout between two adjacent pairs of wings of the barbed strap, whereby at least one tooth has a recess whose length and height make it possible for a pincer leg of a clamping pincer of the clamping device to pass therethrough.

* * * * *